US008550292B2

(12) United States Patent
Alvares et al.

(10) Patent No.: US 8,550,292 B2
(45) Date of Patent: Oct. 8, 2013

(54) CLOSURE ARRANGEMENT FOR A CONTAINER

(75) Inventors: Antonio Carlos Teixeira Alvares, Sao Paulo (BR); Silverio Candido Da Cunha, Lajeado (BR)

(73) Assignee: Brasilata S/A Embalagens Metalicas, Sao-Paulo-SP (BR)

( * ) Notice: Subject to any disclaimer, the term of this patent is extended or adjusted under 35 U.S.C. 154(b) by 567 days.

(21) Appl. No.: 12/435,733

(22) Filed: May 5, 2009

(65) Prior Publication Data

US 2009/0277908 A1 Nov. 12, 2009

(30) Foreign Application Priority Data

May 7, 2008 (BR) ..... 0801964

(51) Int. Cl.
*B65D 41/16* (2006.01)

(52) U.S. Cl.
USPC ..... 220/795; 220/804; 220/641; 220/681; 220/789; 220/378

(58) Field of Classification Search
USPC ..... 220/804, 362, 641, 378, 803, 806, 220/681, 789, 795, 669, 672
See application file for complete search history.

(56) References Cited

U.S. PATENT DOCUMENTS

| | | | | | |
|---|---|---|---|---|---|
| 1,502,673 | A | * | 7/1924 | Hole | 220/324 |
| 1,575,681 | A | * | 3/1926 | Griffiths | 220/619 |
| 1,747,591 | A | * | 2/1930 | Moore | 220/804 |
| 1,895,386 | A | * | 1/1933 | Aulbach | 220/274 |
| 2,854,744 | A | * | 10/1958 | Crockett | 29/516 |
| 3,262,602 | A | * | 7/1966 | McConnell et al. | 220/785 |
| 3,616,962 | A | * | 11/1971 | Phipps | 220/789 |
| 3,749,277 | A | * | 7/1973 | Kinney | 220/785 |
| 4,434,910 | A | * | 3/1984 | Groult | 220/804 |
| 4,679,699 | A | * | 7/1987 | Malsbury et al. | 220/789 |
| 5,918,761 | A | * | 7/1999 | Wissinger | 220/713 |
| 5,979,694 | A | * | 11/1999 | Bennett et al. | 220/613 |

* cited by examiner

*Primary Examiner* — Jacob K Ackun
*Assistant Examiner* — Jenine Pagan
(74) *Attorney, Agent, or Firm* — Fish & Richardson P.C.

(57) ABSTRACT

The closure arrangement is applied to a metallic container comprising a peripheral side wall which presents an upper edge surrounding an opening, in which is fitted a lid having a peripheral upper wall externally provided with a circumferential rib to be fitted in an inner circumferential recess of the peripheral side wall; and a circumferential groove located inferiorly to the circumferential rib and housing a sealing ring to be internally seated against the peripheral side wall upon the fitting and axial retention of the circumferential rib in the circumferential recess.

6 Claims, 2 Drawing Sheets

CLOSURE ARRANGEMENT FOR A CONTAINER

CROSS-REFERENCE TO RELATED APPLICATION

The present application claims priority to and the benefit of Brazilian Patent Application Number PI0801964-9, filed May 7, 2008, which is hereby incorporated by reference in its entirety.

FIELD OF THE INVENTION

The present invention refers to a closure arrangement to be applied in metallic containers, such as pails or other containers and of the type which comprises: a bottom wall; a peripheral side wall which presents an upper edge, surrounding an opening, inside which is fitted and axially locked an also metallic lid, whose peripheral upper wall carries sealing and retention elements which cooperate with the peripheral side wall of the container, to guarantee the closure tightness and a reliable axial locking of the lid in the closed position.

PRIOR ART

There are well known from the prior art the closure arrangements of the type mentioned above and which present the peripheral side wall of the container internally provided with a circumferential groove, inside which is fitted and axially retained a circumferential rib externally provided on the peripheral upper wall of the lid, guaranteeing a reliable axial retention of the latter to the container when in the closed position.

In order to guarantee the closure tightness, the peripheral upper wall of the lid is externally provided with a circumferential groove housing an elastomeric sealing ring, which is pressed against a confronting inner portion of the peripheral side wall upon closing the lid, guaranteeing the desired tightness.

However, the circumferential groove of these known solutions, which houses the sealing ring, is positioned above the outer circumferential rib of the lid. Thus, the mutual fitting and retention region between the outer circumferential rib of the lid and the inner circumferential recess of the peripheral side wall of the container is positioned in a region that is maintained in communication with the inside of the container and the product stored therein.

In cases in which the product stored in the container is aggressive to the metallic material of the container and lid, it is necessary for both the container and lid to be internally protected by a known prior art varnish film, which prevents the sheet metal of the container and lid from being degraded, for example, by oxidation.

In these solutions, however, the varnish film which protects the mutually fitting and retention region between the lid and the container suffers a natural wear, since the first closing of the lid, due to the metal-metal friction caused by the interference fitting under elastic deformation between said two parts, and during possible subsequent opening and closing operations of the lid. With the wear of the protecting varnish, this mutually fitting and retention region becomes unprotected against the aggressive attack of the stored product, allowing the progressive deterioration of the sheet metal in this region to contaminate the stored product.

As a function of the characteristics mentioned above, these known closure solutions cannot be reliably used for containers internally protected with varnish and designed to store products which are aggressive to the sheet metal used in the formation of the container and lid.

Moreover, these known solutions usually present a double axial retention system comprising the mutual fitting of two pairs of confronting ribs and grooves incorporated to the peripheral side wall and the peripheral upper wall of the lid, so as to guarantee a more intense axial retention, but which increases even more the metal-metal friction region and the rupture of the varnish protecting layer.

SUMMARY OF THE INVENTION

As a function of the inconveniences mentioned above, it is an object of the present invention to provide a closure arrangement for containers of the type commented above, which guarantees a reliable retention of the lid to the container, a high degree of closure tightness, and which can be reliably applied to the metallic containers internally provided with a protective varnish film, without risks of the varnish wear in the mutually fitting and retention region between the lid and the container, producing contaminants which may contact the stored product.

According to the invention, the circumferential groove which carries the sealing ring is provided in a region of the peripheral upper wall of the lid located inferiorly to the outer circumferential rib of said peripheral upper wall of the lid. With this construction, the sealing ring is seated against a sealing portion of the peripheral side wall defined beneath the circumferential recess of the latter, in which the outer circumferential rib of the lid is fitted. The sealing ring is thus positioned inferiorly to the mutually fitting and retention region in which varnish wear occurs between the lid and the container.

BRIEF DESCRIPTION OF THE DRAWINGS

The invention will be described below, with reference to the enclosed drawings, given by way of example of a possible embodiment of the invention and in which.

DETAILED DESCRIPTION OF THE INVENTION

Figure 1:
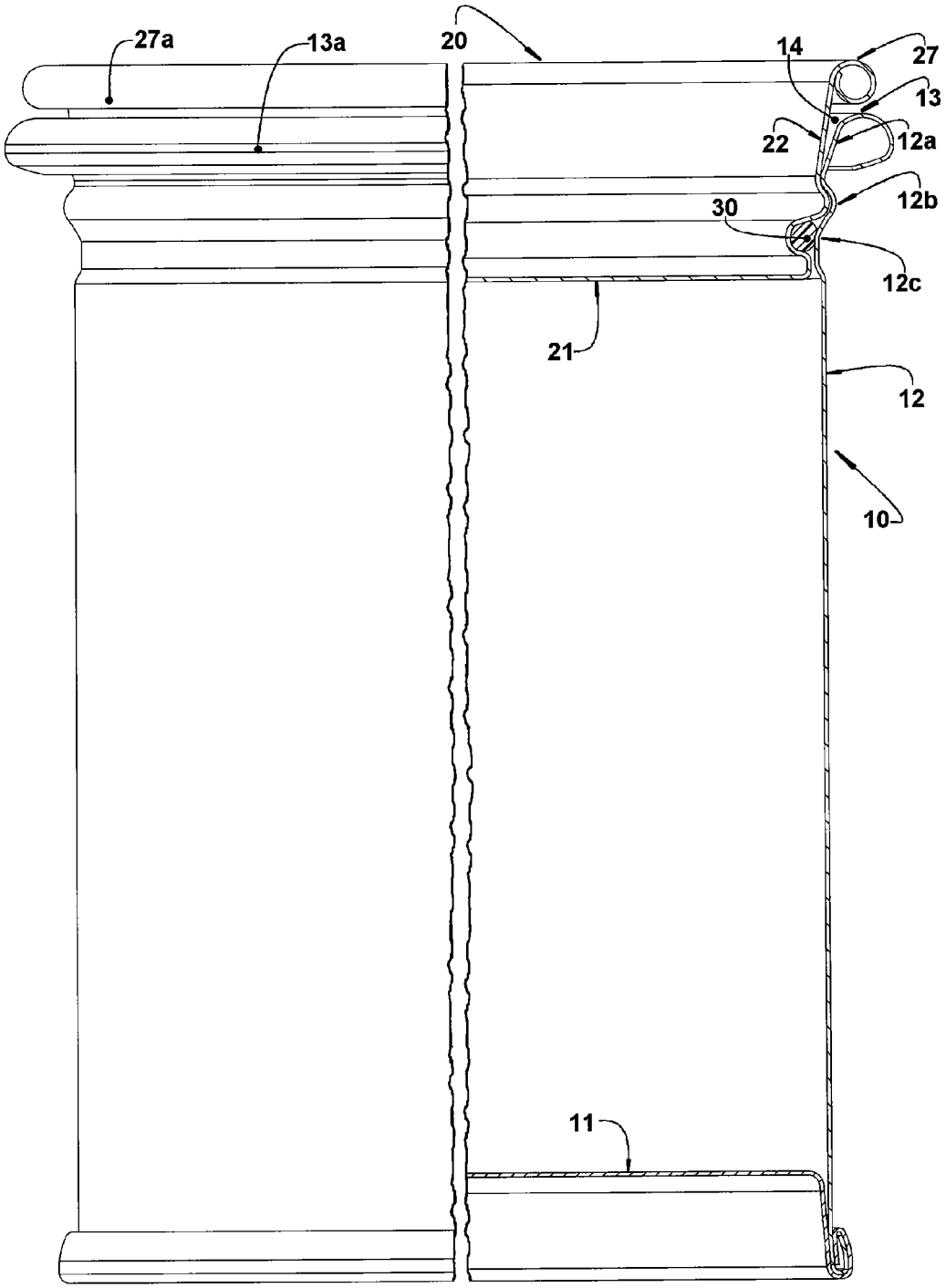
FIG. 1 represents a partially cut lateral view of a metallic pail, superiorly provided with the constitutive elements of the closure arrangement and onto which is fitted a metallic lid.
Figure 2:
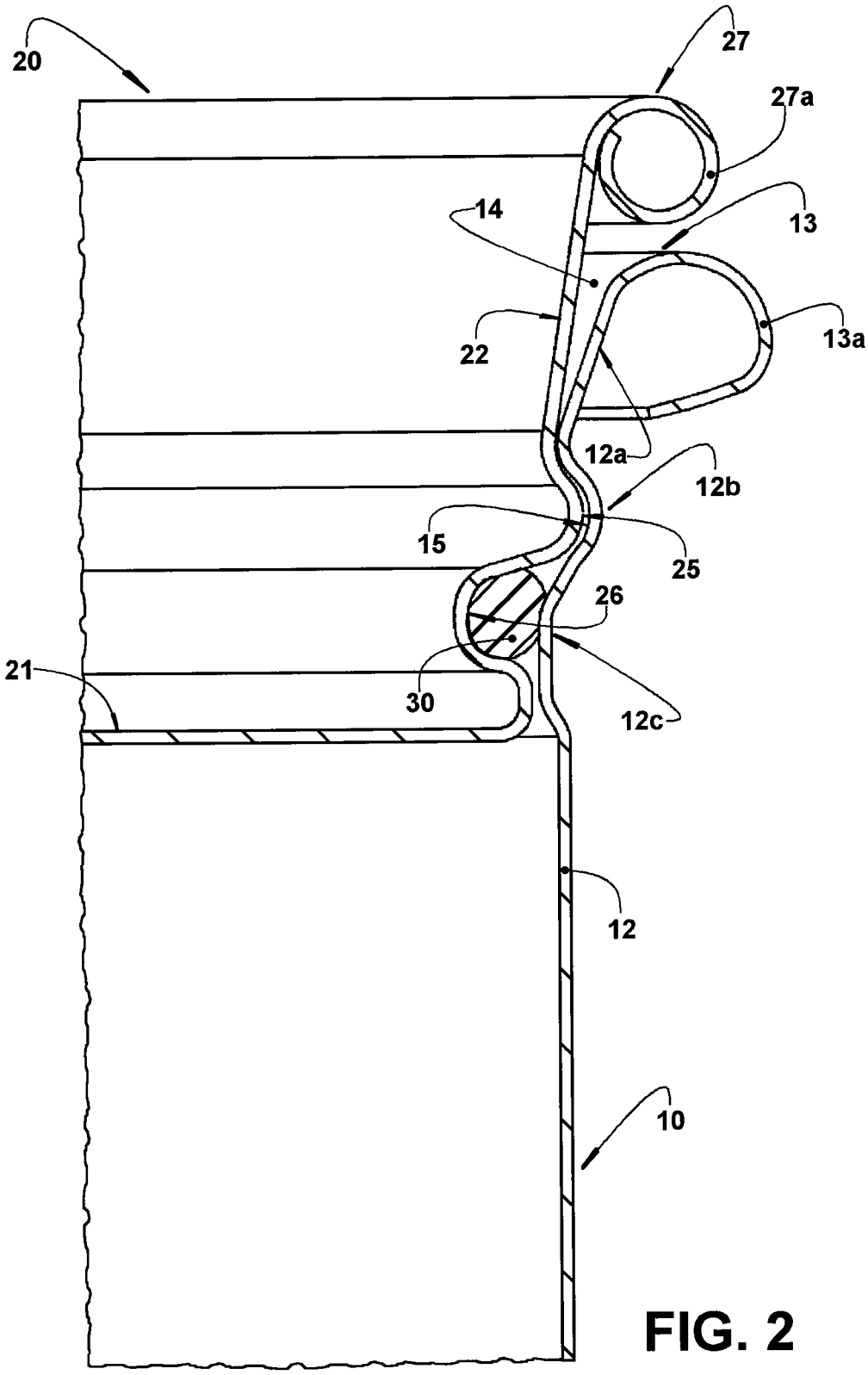
FIG. 2 represents an enlarged detail of part of the cutout portion of FIG. 1, in the mutually fitting and retention region of the lid.

As already previously mentioned, the present closure arrangement is applied to a container 10, generally in the form of a pail and made of sheet metal, usually tinplate, and which presents a tubular body with a circular or polygonal cross-section. The container 10 is inferiorly closed by a bottom wall 11 and comprises a peripheral side wall 12 provided with an upper edge 13 surrounding an opening 14 in which is fitted a metallic lid 20, whose fitting and retention to the container 10 occurs as described ahead.

In the illustrated construction, the bottom wall 11 is double seamed to the peripheral side wall 12. However, other bottom wall constructions can be used, without this aspect constituting a limitation for the inventive concept presented herein.

Generally, the upper edge 13 of the container 10 is outwardly, downwardly and inwardly bent, so as to define a tubular rib 13*a*.

According to the present arrangement, the peripheral side wall 12 of the container 10 defines, axially beneath the upper edge 13 of the latter and sequentially in a downward direction, an end portion 12*a* disposed immediately above a retention portion 12*b* which is, on its turn, disposed above a sealing portion 12*c* and, preferably, adjacent to the latter.

According to the present invention, the sealing portion 12*c* is defined by an axial extension of the peripheral side wall 12 and presents an inner diameter inferior to the smallest diameter of the retention portion 12*b*, said sealing portion 12*c*, in the illustrated construction, presenting its inner diameter inferior to the inner diameter of the extension of the peripheral side wall 12 disposed immediately beneath said sealing portion 12*c*.

In the particular construction illustrated in the drawings, the sealing portion 12*c* is cylindrical and the upper portion 12*a* presents a generally inverted frusto-conical configuration.

The peripheral side wall 12 internally incorporates at least one circumferential recess 15 provided in the retention portion 12*b* and which actuates for retaining the lid 20 to the container 10.

The circumferential recess 15 is, for example, continuous and in a horizontal V-profile, having the rounded apex in a convex arc and the sides tangentially matching the peripheral side wall 12 of the container 10.

It should be understood that the circumferential recess 15 can present other profiles (such as a triangular cross-section profile) besides that illustrated and for example, constituted by a plurality of portions of circumferential recess 15 distributed along one or more planes orthogonal to the axis of the container 10 and each actuating against a respective region of the lid 20, so as to lock the latter against the container 10, upon fitting the lid 20 in the interior of the opening 14 of said container 10. The form and the number of portions of circumferential recess 15 are not limitative to the closure arrangement concept of the present invention.

The lid 20 comprises a median lower wall 21, generally of circular contour, and from which a peripheral upper wall 22 projects upwardly, surrounding the median lower wall 21 and externally provided with a circumferential rib 25 and a circumferential groove 26 positioned beneath the circumferential rib 25. In the illustrated construction, the peripheral upper wall 22 of the lid 20 incorporates an outwardly, downwardly and inwardly bent edge 27, so as to define a tubular peripheral rib 27*a*.

The circumferential rib 25 of the lid 20 is configured to be fitted in the circumferential recess 15 of the peripheral side wall 12, upon fitting the lid 20 in the interior of the opening 14 of the container 10, and the circumferential groove 26 is configured to house a sealing ring 30, to be internally seated against the peripheral side wall 12 of the container 10, upon the fitting and axial retention of the circumferential rib 25 of the lid 20 in the circumferential recess 15 of the peripheral side wall 12. The circumferential groove 26 is conformed so as to maintain the sealing ring 30 radially spaced back in relation to the circumferential rib 25. The sealing ring 30 is formed in any adequate material, for example, an elastomer.

According to the illustrated figures, the circumferential rib 25 is continuous and has a horizontal V-profile, having the rounded apex in convex arc and the sides coincident with the peripheral upper wall 22 of the lid 20, allowing defining a circumferential step external to said lid 20, without producing any cutting edge in the outer surface of the latter. In a similar manner, the circumferential groove 26 presents a horizontal V-profile, having the rounded apex in convex arc and the sides coincident with the peripheral upper wall 22 of the lid 20.

It should be understood that the circumferential recess 15 and/or the circumferential groove 26 can present other profiles (such as a triangular cross-section profile) besides that illustrated.

In the illustrated construction, the circumferential rib 25 is partially fitted in the circumferential recess 15. Nevertheless, it should be understood that said fitting can be obtained with a complete mutual seating of the parts of circumferential rib 25 and circumferential recess 15.

With the construction of the present invention, the circumferential groove 26 carrying the sealing ring 30 is provided inferiorly to the circumferential rib 25 of the lid 20, so that the sealing ring 30 is seated against the sealing portion 12*a* of the peripheral side wall 12.

It should be observed that the parts of circumferential recess 15, circumferential rib 25, circumferential groove 26 and sealing portion 12*c* are preferably defined by respective radial deformations of the peripheral side wall 12 of the container and of the peripheral upper wall 22 of the lid 20. Moreover, although said parts are provided continuous, representing a way of carrying out the present invention, this construction is not limitative of the present concept.

According to the present invention, the sealing portion 12*c* of the peripheral side wall 12 is defined by an axial extension of the latter that presents an inner diameter inferior to the smallest diameter of the retention portion 12*b*, allowing the sealing ring 30, slightly projecting from the circumferential groove 26, to be pressed against said sealing portion 12*c*, upon the locking of the lid 20 in the container 10, guaranteeing the closure tightness of the container 10, without said sealing ring 30 contacting the end portion 12*a* and retention portion 12*b*, during the axial displacements of fitting and unfitting the lid 20 in relation to the container 10.

As illustrated herein, the end portion 12*a* of the peripheral side wall 12 preferably presents a generally inverted frusto-conical configuration, permitting the friction between the lid 20 and the peripheral side wall 12 to occur only when the circumferential rib 25 of the lid 20 reaches the retention portion 12*b*. Accordingly, the circumferential rib 25 of the lid 20 and the circumferential recess 15 of the peripheral side wall 12 define the single mutual metal-metal friction region between the lid and container.

During the introduction and removal of the lid 20 in relation to the opening 14 of the container 10, the circumferential rib 25 suffers an elastic deformation upon passing through the upper region of the retention portion 12*b* which region presents a diameter inferior to that of the circumferential rib 25 of the lid 20.

This constructive arrangement not only allows the lid 20 to be tightly sealed inside the container 10, even with subsequent openings of the latter during the progressive consumption of the stored product or during subsequent uses of the container for storing replacement loads (refills) of different products to be hermetically stored, but also prevents the degradation of the inner protective varnish and the respective sheet metal regions in said mutual metal-metal friction region between the lid 20 and the container 10 from contaminating and deteriorating the stored product.

The construction proposed herein and described above allows carrying out multiple opening and closing operations of the container by means of the lid, obtaining a secure and reliable retention of the lid in the container, as well as a high degree of tightness whenever the lid is fitted and locked to the container.

While only one embodiment of the present invention has been illustrated herein, it should be understood that alterations can be made in the form and disposition of the elements, without departing from the constructive concept defined in the claims that accompany the present specification.

The invention claimed is:

1. A closure arrangement for a container comprising:

a bottom wall;

a peripheral side wall which presents an upper edge surrounding an opening and which internally incorporates a circumferential recess;

a lid comprising a median lower wall and a peripheral upper wall externally provided with a circumferential rib configured to be fitted in the circumferential recess of the peripheral side wall, so as to lock the latter against the container, upon fitting the lid in the interior of said opening; and a circumferential groove configured to house a sealing ring to be internally seated against the peripheral side wall, upon the fitting and axial retention of the circumferential rib in the circumferential recess, the sealing ring free from contact with an end portion and a retention portion during axial displacement of the fitting and unfitting of the lid in relation to the container;

the circumferential groove, carrying the sealing ring, is provided inferiorly to the circumferential rib of the lid, so that the sealing ring is seated against a sealing portion of the peripheral side wall defined beneath the circumferential recess of the latter, wherein the peripheral side wall defines, beneath the upper edge and sequentially in a downward direction, the end portion, the retention portion and the sealing portion.

2. The closure arrangement, as set forth in claim 1, wherein the sealing portion of the peripheral side wall is defined by an axial extension of the peripheral side wall presenting an inner diameter smaller than the smallest diameter of the retention portion of the peripheral side wall defined between said sealing portion and the upper edge.

3. The closure arrangement, as set forth in claim 2, wherein the sealing portion of the peripheral side wall is cylindrical.

4. The closure arrangement, as set forth in claim 2, wherein the peripheral side wall presents, immediately above said retention portion, the end portion having a generally inverted frusto-conical configuration.

5. The closure arrangement, as set forth in claim 2, wherein the sealing portion of the peripheral side wall presents an inner diameter smaller than the inner diameter of the extension of the peripheral side wall disposed immediately below.

6. The closure arrangement, as set forth in claim 1, wherein the circumferential groove is conformed so as to maintain the sealing ring radially spaced back in relation to the circumferential rib.

* * * * *